US006345953B1

(12) United States Patent
Henkel et al.

(10) Patent No.: US 6,345,953 B1
(45) Date of Patent: Feb. 12, 2002

(54) TURBINE HOUSING

(75) Inventors: Norbert Henkel, Düsseldorf; Uwe Zander, Mülheim an der Ruhr; Edwin Gobrecht, Ratingen, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/622,614

(22) PCT Filed: Dec. 8, 1998

(86) PCT No.: PCT/DE98/03607

§ 371 Date: Jan. 5, 2001

§ 102(e) Date: Jan. 5, 2001

(87) PCT Pub. No.: WO99/42705

PCT Pub. Date: Aug. 26, 1999

(30) Foreign Application Priority Data

Feb. 18, 1998 (DE) ..... 198 06 809

(51) Int. Cl.[7] ..... F01D 25/26
(52) U.S. Cl. ..... 415/108; 415/200; 415/220
(58) Field of Search ..... 415/108, 200, 415/220

(56) References Cited

U.S. PATENT DOCUMENTS 4,728,257 A * 3/1988 Handschuh ..... 415/136
5,123,241 A * 6/1992 Lotan ..... 60/39.75
5,975,845 A * 11/1999 Ball ..... 415/173.4

* cited by examiner

*Primary Examiner*—Edward K. Look
*Assistant Examiner*—Kimya McCoy
(74) *Attorney, Agent, or Firm*—Staas & Halsey LLP

(57) ABSTRACT

The present invention relates to a turbine housing (1) having an inner housing (2) which is surrounded by an outer housing (3), the inner housing (2) and the outer housing (3) each having a first, upper partial region (5) and a second, lower partial region (6), and having an inner-housing outer surface (7) and an outer-housing inner surface (8) which are positioned opposite one another, with a distance between them. At least in a part of the first partial region (5), the inner-housing outer surface (7) has a lower heat transfer through radiation to the opposite outer-housing inner surface (8) than at least in a part of the second partial region (6) of the inner-housing outer surface (7). This can be achieved by means of suitable surface coatings in the respective regions which have different absorption and/or emission coefficients ($a_1$, $a_2$). The result is a temperature compensation between the upper side and the lower side of the corresponding housing (2, 3), so that distortion of the housing during cooling is avoided.

20 Claims, 3 Drawing Sheets

TURBINE HOUSING

CROSS-REFERENCE TO RELATED APPLICATIONS

This application is based upon and claims priority to German Patent Application No. 198 06 809.3 filed Feb. 18, 1998 and International Application No. PCT/DE98/03607, the contents of which are incorporated herein by reference.

BACKGROUND OF THE INVENTION

The present invention relates to a turbine housing having an inner housing which is surrounded by an outer housing, in particular for steam turbines. The inner housing and the outer housing each have a first, upper partial region and a second, lower partial region. These partial regions are often designed as separate housing parts. An inner-housing outer surface is positioned opposite an outer-housing inner surface, with a distance between them.

The article "Temperaturermittlung in Turbinengehäusen" [Temperature determination in turbine housings] by Robert Erich in: Allgemeine Wärmetechnik, Zeitschrift für Wärme-, Kälte- und Verfahrenstechnik, Vol. 9, 1959, pages 163 to 182 deals with the different heating of individual structural elements of a steam turbine during start-up and in the event of load changes during operation. Different heating of this nature causes deformation of the material and stresses which are superimposed on the stresses caused by the steam pressure. The aim of the article is to use calculated and determined temperature distributions to obtain criteria for selecting the steels which are to be used. Then, all the required clearances and gaps can be suitably dimensioned using the thermal expansions which have been determined, which is extremely important when combining two workpieces with different coefficients of expansion. Furthermore, the intention is that it should be possible to use the temperature distributions which have been determined in this way to derive guidelines indicating how known turbines heat up from the cold state and the speed at which load changes should be performed without causing creep phenomena in the material as a result of excess loads.

SUMMARY OF THE INVENTION

The object of the present invention is to keep distortion of the turbine housing during cooling at a low level.

The invention is based on the recognition that, in a steam turbine which has a turbine outer housing and a turbine inner housing or a guide-vane carrier, temperature differences arise after the turbine has been switched off and between the respective housings or between the outer housing and a guide-vane carrier. These temperature differences can lead to distortion of both housings, which in turn leads to undesirable stresses and to clearances being bridged. This means that under adverse conditions turbine blades may strip the housing and thus cause stripping damage. Because of its appearance, the distortion which occurs during natural cooling of the outer housing is also referred to by the term "bowing".

The turbine housing has an inner housing which is surrounded by an outer housing. In the following text, the term "inner housing" is also understood as meaning a guide-vane carrier. The inner housing and the outer housing are each divided into a first, upper partial region and a second, lower partial region. An inner-housing outer surface and an outer-housing inner surface are positioned opposite one another, with a distance between them. The inner-housing outer surface and the opposite outer-housing inner surface, at least in a part of their respective first partial regions, are designed in such a way that, in those regions, they exhibit a lower heat transfer through radiation than at least in a part of their respective second partial regions. This makes it possible, after the turbine has been switched off, to prevent the outer housing from cooling too quickly with respect to the inner housing. This is because if the inner-housing outer surface were to exhibit approximately the same heat transfer to the opposite outer-housing inner surface in the first and second partial regions, a not inconsiderable rising flow would be initiated in the upper region in the intermediate space formed between the two opposite surfaces. This rising flow would lead to a higher introduction of heat into the first, upper partial region of the outer housing. According to the invention, with cooling by natural convection, the lower heat transfer in the first partial region makes it possible to provide temperature compensation, so that the temperature difference between the first, upper partial region and the second, lower partial region can be considerably below previously known temperature differences of over 50 Kelvin with natural cooling and without additional measures.

A first, particularly advantageous configuration for forming a lower heat transfer as a result of radiation involves the inner housing, in the first partial region on the inner-housing outer surface, having a first emission coefficient which is lower than a second emission coefficient of the second partial region on the inner-housing outer surface. For temperature compensation, it has proven advantageous if the first emission coefficient is below 0.5 and the second emission coefficient is above 0.5. This is also to be considered dependent on the material used for the inner and/or outer housing. In fact, to avoid stresses in the housings themselves, both housings usually consist in each case of the same type of material. The emission coefficient of the material in question can still be decisively influenced by suitable surface processing, for example by controlled roughening of the surface, in order in this way to obtain a suitable emission coefficient. Preferably, the surface is processed in such a way that the material's properties, such as strength and resistance to corrosion, are at most affected to an insignificant extent.

A refinement to the use of different emission coefficients in the first, upper partial region and the second, lower partial region for the inner-housing outer surface involves a material in the first partial region having a lower emission coefficient than another material which, in this case, however, is applied to the inner-housing outer surface in the second partial region. This makes it possible to continue to employ the materials which have previously been used for the inner and outer housings. The material to be applied has a higher emission coefficient than the inner housing. In this way, a desired, positive radiation effect can be intensified. Preferably, the material to be applied is an oxide ceramic, e.g. zirconium oxide. Furthermore, other coating materials with a suitable radiation property and ability to bond to the material of the housing may also be used. A coating material is preferably also resistant to corrosion in steam. The layer thickness in which the coating material is applied may, for example, be in the range between 50 mm and 100 mm. On the one hand, this offers a particularly high emission coefficient, for example of e=0.8 or higher. On the other hand, the oxide ceramic can be reliably applied to conventional housing material, for example GGG-40, in such a manner that it is able to provide a long service life. One example of a suitable technique for applying a thin film of the oxide ceramic is plasmaspraying. Furthermore, the application method, as well as the oxide ceramic itself, ensure that high chemical resistance to the media which are found in the turbine housing is also provided. In this case, the coating material preferably has a coefficient of thermal expansion which is also suitable, with regard to transient temperature states, for keeping the risk of the housing material flaking at a low level.

A further design aimed at achieving a lower heat transfer through radiation in a part of the first partial region of the inner-housing outer surface to the opposite outer-housing surface compared to a part of the second partial region of the inner-housing outer surface is achieved by the fact that at least a part of the second partial region of the outer-housing inner surface has a greater absorption coefficient than a part of the first partial region of the outer-housing inner surface. This likewise makes it possible to introduce an increased amount of heat into the second, lower partial region of the outer housing. This in turn, once again, evens out the temperatures of the outer housing. Since, as a result, the driving temperature gradient for natural convection between the inner housing and the outer housing is reduced, this design also counteracts natural convection.

A refinement of the configuration of the second partial region with a higher absorption coefficient has a third material in the second partial region on the outer-housing inner surface. This third material has a higher absorption coefficient than a fourth material of the outer-housing inner surface in the first partial region. This third material is either the material of the outer-housing inner surface in the second partial region itself, in which case its surface has been suitably machined, or alternatively the third material may be an additional material which has been applied to the outer-housing inner surface in the second partial region. A further possibility for changing the absorption coefficients between the first, upper partial region and the second, lower partial region of the outer-housing inner surface consists in altering the outer-housing inner surface in the first, upper partial region in such a way that it has a lower absorption coefficient than the outer-housing inner surface of the second, lower partial region.

BRIEF DESCRIPTION OF THE DRAWINGS

Exemplary embodiments of the invention, as well as further advantages and features thereof, are explained in more detail with reference to the following drawing, in which.

DETAILED DESCRIPTION OF THE PREFERRED EMBODIMENTS

Figure 1:
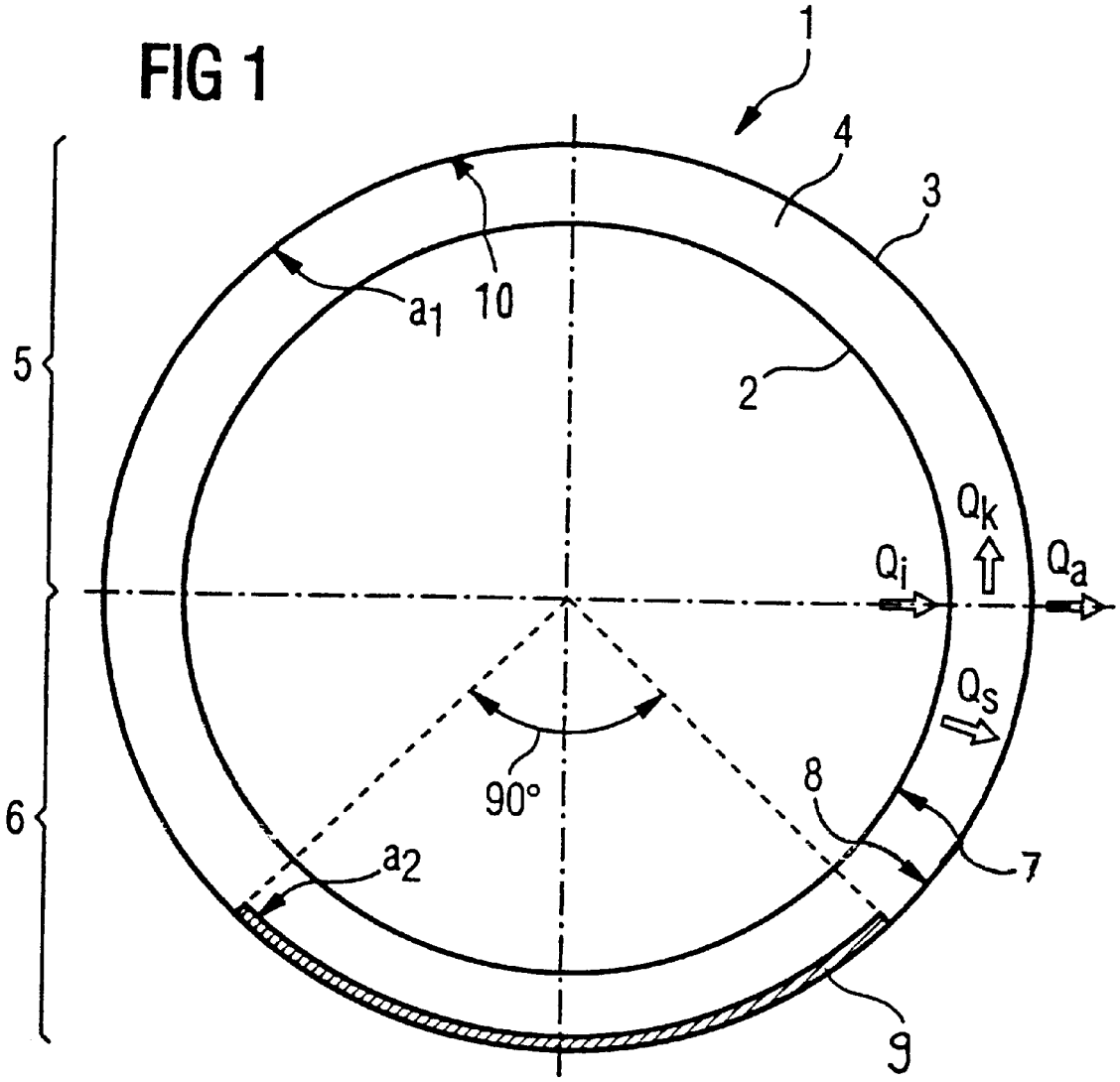
FIG. 1 shows a preferred design of the invention, in which a material has been applied to an outer-housing inner surface.

FIG. 1 diagrammatically depicts a turbine housing 1. The turbine housing 1 has an inner housing 2 and an outer housing 3, which is preferably concentric with respect to the inner housing 2. As an alternative to an inner housing 2, it would also be possible to provide a guide-vane carrier. The inner housing 2 and the outer housing 3 are spaced apart from one another in such a way that an intermediate space 4 is formed. This intermediate space 4 is filled with a gaseous medium, in particular steam in the case of a steam turbine, which is capable of convection. The inner housing 2 and the outer housing 3 can each be divided into a first, upper partial region 5 and a second, lower partial region 6.

If a heat flux through the turbine housing 1 is now considered, the result is an inner heat flux Qi through the inner housing 2 and an outer heat flux Qa through the outer housing 3. Within both the housings 2, 3 there is a conduction heat flux which is in each case dependent on the thermal conductivity. By way of example, the outer housing 3 is a cast housing produced using spheroidal graphite (GGG-40). The associated thermal conductivity is approximately 30 W/mK. The thickness of the outer housing 3 is approximately 100 to 150 mm. Between the inner housing 2 and the outer housing 3, there is firstly a heat transfer through a convection heat flux QK and through a radiation heat flux QS. The latter is effective from the inner-housing outer surface 7 to the outer-housing inner surface 8. The outer-housing inner surface 8 in the first, upper partial region 5 has a first absorption coefficient a1 which is lower than a second absorption coefficient a2 in a part of the second, lower partial region 6. To achieve this effect, the outer-housing inner surface 8 is treated specially either in the second, lower partial region 6 or in the first, upper partial region 5. The particularly advantageous solution illustrated here involves a first material 9 being applied to the outer-housing inner surface in the second partial region 6. The first material 9 forms a thin film of low material thickness, so that the improved uptake of radiation heat caused by the second absorption coefficient a2 being greater than the first absorption coefficient a1 is not eliminated again by an excessively high resistance to heat conduction. In this case, the first material 9 extends over an angular range of approximately 90°. However, the angular range may also be considerably smaller or even larger, for example as a function of a heat gradient over the length of the turbine. The fact that the first material 9 is better able to absorb radiation heat than a second material 10 in the first partial region 5 means that the second partial region 6 absorbs a considerably greater heat flux than without the first material 9. This counteracts the convection heat flux QK in the first partial region 5 and leads to a lower temperature difference between the first partial region 5 and the second partial region 6 when the turbine is shut down. Zirconium oxide ($ZrO_2$), which is advantageously applied by plasma spraying, has proven to be a first material 9 which can be subjected to extremely high loads. Even with a small thickness, a layer of this type is able to withstand even relatively aggressive media in the intermediate space 4. At a radiation temperature of approximately 350° C., as occurs over a prolonged period when a turbine is shut down, furthermore, this oxide ceramic has an absorption coefficient of approximately 0.9. This is considerably higher than an absorption coefficient of approximately 0.25 for an outer housing 3 made from the material referred to above. Furthermore, it should be noted that the first absorption coefficient $a_1$ and also the second absorption coefficient $a_2$ are temperature-dependent. In the event of the temperature changing over the course of time during the cooling operation after the turbine has been shut down, zirconium oxide also fulfills the requirement of having a high absorption coefficient over a wide temperature range.

Figure 2:
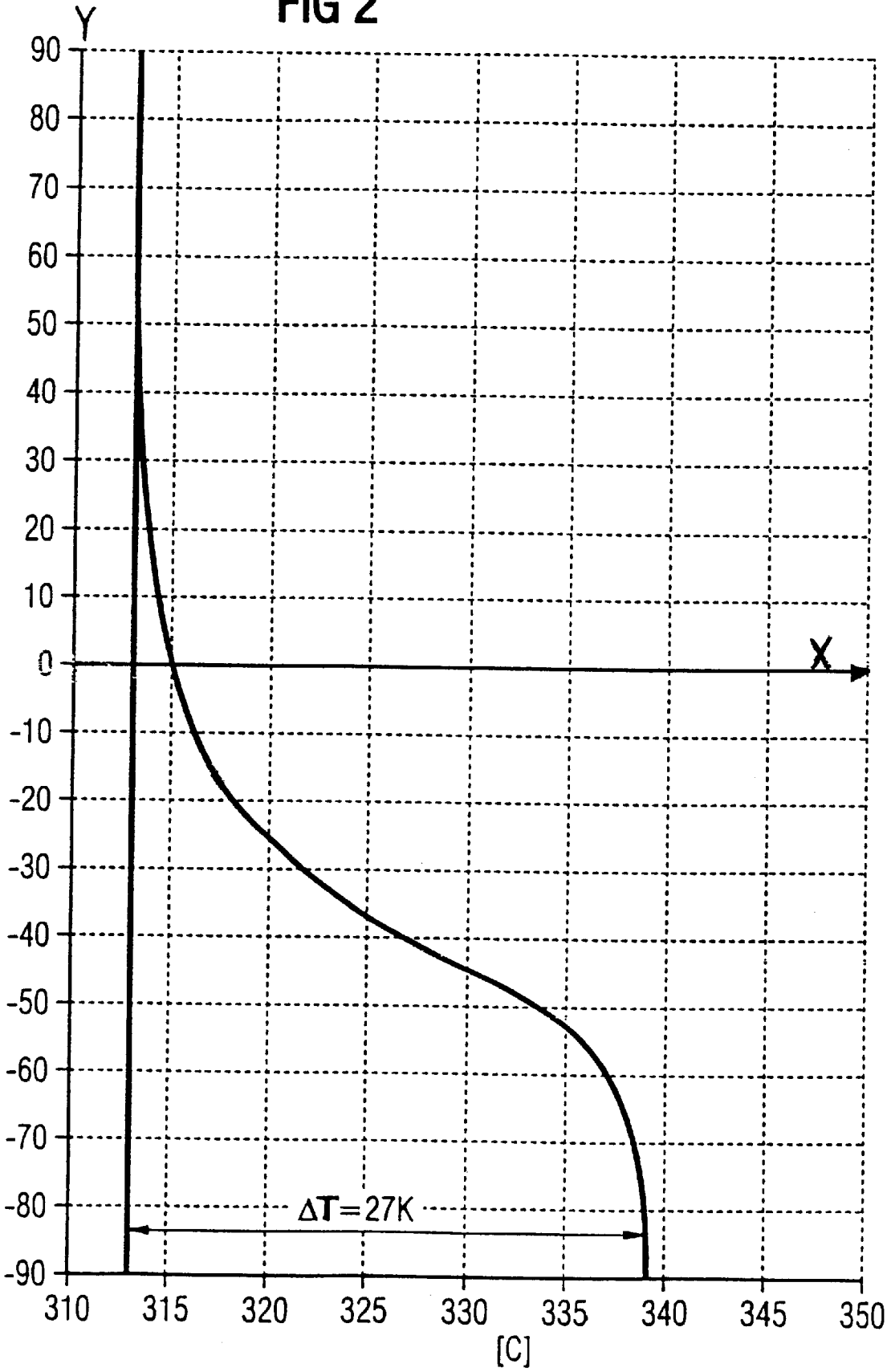
FIG. 2 shows a temperature distribution as results, leaving aside natural convection, through radiation effects in the design shown in FIG. 1 after the turbine has been switched off.
Figure 3:
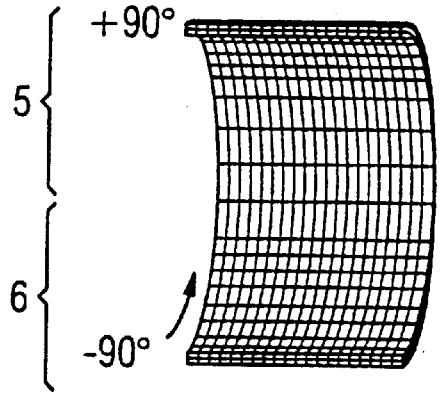
FIG. 3 shows a diagrammatic, perspective view of an outer housing.

FIG. 2 shows a system of XY coordinates. The X-axis shows a measured temperature of the outer-housing inner surface 8 from FIG. 1. The Y-axis shows the position of the measurement in degrees. To illustrate the position of the measurement, FIG. 3 shows a diagrammatic view of the outer housing 3, divided up into a calculation grid. On the Y-axis shown in FIG. 2, the degree indicator starts at −90° in the second, lower partial region 6 from FIG. 1, running up to the indication of +90° in the first, upper partial region 5 as shown in FIG. 1. Due to the different absorption coefficients, the maximum temperature difference between the first partial region 5 and the second partial region 6 resulting only from the changed radiation conditions is D T=27 K. This temperature difference D T caused by the radiation at least partially compensates for a considerable temperature difference of at least 50 K between the first partial region 5 and the second partial region 6 which would otherwise occur when different absorption coefficients are not used. To ensure that this result is achieved, it is advantageous for the first absorption coefficient $a_1$ in the first partial region 5 to be below 0.5 and the second absorption coefficient $a_2$ in the second partial region 6 to be above 0.5.

Figure 4:
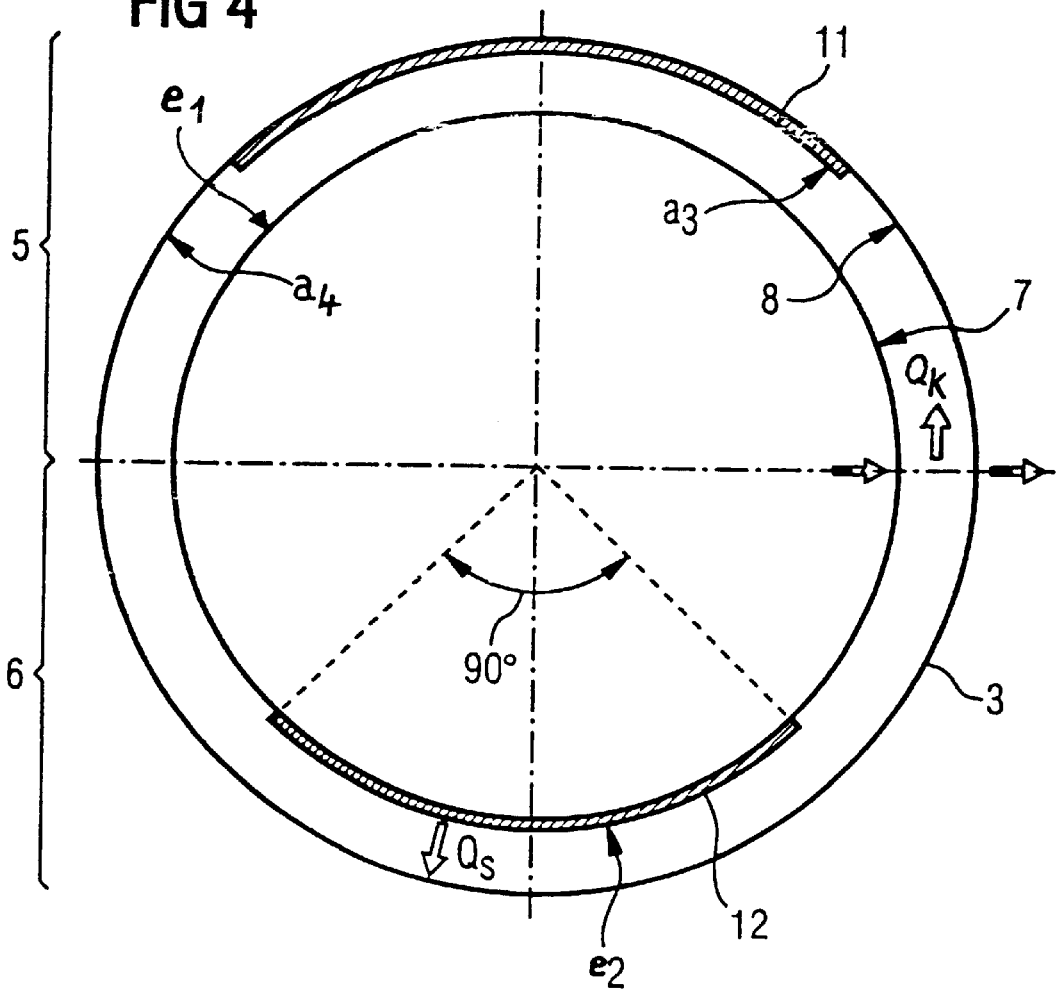
FIG. 4 shows a further configuration of the invention, in which a further material has been applied to an outer-housing inner surface.

FIG. 4 shows a further configuration for utilizing the thermal radiation to compensate for temperature differences. To simplify the drawing, in FIG. 4 identical components are provided with identical reference symbols to those employed in FIG. 1. Firstly, the outer-housing inner surface 8 has a third material 11 in the first partial region 5. The third absorption coefficient $a_3$ of this third material 11 is lower than the absorption coefficient $a_4$ of the outer-housing inner surface 8 in the second partial region 6. Secondly, in the second partial region 6 the inner-housing outer surface 7 has a fourth material 12. The inner-housing outer surface 7 in the first partial region 5 has a first emission coefficient $e_1$ which is lower than a second emission coefficient $e_2$ of this fourth material 12. It is preferable for the first emission coefficient $e_1$ to be below 0.5 and for the second emission coefficient $e_2$ to be above 0.5. In this way, a higher radiation heat flux QS flows from the inner-housing outer surface 7 to the outer-housing inner surface 8 in the second partial region 6 than in the first partial region 5. This in turn leads to the convection heat flux QK being counteracted by the temperatures in the outer housing 3 being made more even.

The invention has been described in detail with particular reference to preferred embodiments thereof and examples, but it will be understood that variations and modifications can be effected within the spirit and scope of the invention.

What is claimed is:

1. A turbine comprising:

an inner housing having an outer surface;

an outer housing surrounding the inner housing, inner and outer housings each having a first, upper region and a second, lower region, the outer housing having an inner surface positioned opposite to the outer surface of the inner housing with a distance therebetween, the outer surface of the inner housing and the inner surface of the outer housing both exhibiting less heat transfer through radiation in a portion of the first region than in a portion of the second region.

2. The turbine housing as claimed in claim 1, wherein the outer housing has a greater absorption coefficient in a portion of the second region than in a portion of the first region.

3. The turbine housing as claimed in claim 2, wherein the inner surface of the outer housing has a greater absorption coefficient in a portion of the second region than in a portion of the first region.

4. The turbine housing as claimed in claim 3, wherein the outer housing is formed of a base material and a coating material, the coating material defines the inner surface of the outer housing in a portion of the second region, and the coating material has a greater absorption coefficient than the base material.

5. The turbine housing as claimed in claim 4, wherein the coating material is a ceramic oxide.

6. The turbine housing as claimed in claim 3, wherein the outer housing is formed of a base material and a coating material, the coating material defines the inner surface of the outer housing in a portion of the first region, and the coating material has a lower absorption coefficient than the base material.

7. The turbine housing as claimed in claim 4, wherein the coating material is formed on the base material by plasma spraying.

8. The turbine housing as claimed in claim 5, wherein the coating material is formed on the base material by plasma spraying.

9. The turbine housing as claimed in claim 6, wherein the coating material is formed on the base material by plasma spraying.

10. The turbine housing as claimed in claim 1, wherein the inner surface of the outer housing has an absorption coefficient of less than 0.5 in the first region and greater than 0.5 in the second region.

11. The turbine housing as claimed in claim 4, wherein the absorption coefficient of the inner surface of the outer housing is less than 0.5 in the first region and greater than 0.5 in the second region.

12. The turbine housing as claimed in claim 6, wherein the absorption coefficient of the inner surface of the outer housing is less than 0.5 in the first region and greater than 0.5 in the second region.

13. The turbine housing as claimed in claim 1, wherein the outer surface of the inner housing has first and second emission coefficients in the first and second regions, respectively, the first emission coefficient being less than the second emission coefficient.

14. The turbine housing as claimed in claim 2, wherein the outer surface of the inner housing has first and second emission coefficients in the first and second regions, respectively, the first emission coefficient being less than the second emission coefficient.

15. The turbine housing as claimed in claim 13, wherein the first emission coefficient is less than 0.5 and the second emission coefficient is greater than 0.5.

16. The turbine housing as claimed in claim 14, wherein the first emission coefficient is less than 0.5 and the second emission coefficient is greater than 0.5.

17. The turbine housing as claimed in claim 1, wherein the inner housing includes a base material and a coating material, and the coating material defines a portion of the outer surface of the inner housing.

18. The turbine housing as claimed in claim 2, wherein the inner housing includes a base material and a coating material, and the coating material defines a portion of the outer surface of the inner housing.

19. The turbine housing as claimed in claim 4, wherein the inner housing includes a base material and a coating material, and the coating material defines a portion of the outer surface of the inner housing.

20. The turbine housing as claimed in claim 6, wherein the inner housing includes a base material and a coating material, and the coating material defines a portion of the outer surface of the inner housing.

* * * * *